US005141035A

United States Patent [19]

Nish et al.

[11] Patent Number: 5,141,035

[45] Date of Patent: Aug. 25, 1992

[54] FILL VALVE ADAPTER AND METHODS

[75] Inventors: Terry E. Nish; Cecil R. McCray, both of Salt Lake City, Utah

[73] Assignee: Servi-Tech, Inc., Salt Lake City, Utah

[21] Appl. No.: 602,574

[22] Filed: Oct. 24, 1990

[51] Int. Cl.[5] ..... B65B 3/04

[52] U.S. Cl. ..... 141/1; 141/31; 141/57; 141/84

[58] Field of Search ..... 141/1, 31, 84, 98, 57, 141/286; 29/890.121, 890.124, 401.1

[56] References Cited

U.S. PATENT DOCUMENTS 4,387,748 6/1983 White ..... 141/57

4,750,533 6/1988 Yun ..... 141/46

*Primary Examiner*—William A. Cuchlinski, Jr.

*Assistant Examiner*—W. Morris Worth

*Attorney, Agent, or Firm*—Lynn G. Foster

[57] ABSTRACT

The present application discloses an invention which addresses and resolves long standing lid size reduction problems in the beverage-canning industry and comprises diametrally reduced adapter nozzles, and related methods, used as replacements only for the nonaccommodating distal discharge nozzle structure of a commercially existing fill valve, which is preferably removed by conventional machining techniques. The adapter nozzles preferably comprise a single die cast stainless steel article. Each adapter nozzle is fastened to the non-removed portion or remainder of the fill valve in sealed relation and comprises a plurality of angularly disposed beverage flow passageways which selectively converts beverage flow from several streams issuing from the remainder of the existing fill valve into three broard, although thin streams and discharges the three beverage streams angularly against the top region of the interior surface of the side wall of the can having reduced size lid opening so that foaming, if any, is within tolerable limits. Each adapter nozzle also comprises a passageway by pressurized gas is selectively delivered to and evacuated from the interior of the can.

36 Claims, 3 Drawing Sheets

FILL VALVE ADAPTER AND METHODS

FIELD OF THE INVENTION

The present invention relates generally to machinery by which a predetermined quantity of beverage is placed in a can after which the can is capped and more particularly to novel beverage adapter nozzles, and related methods, which replaces an existing flared distal nozzle portion of a standard beverage fill valve whereby filling of a can having a smaller diametral opening in the top thereof is accommodated.

BACKGROUND AND RELATED ART

Typical of automated machinery by which a beverage, such as soda pop and beer, is dispensed into open top, later capped cans are the disclosures of U.S. Pat. Nos. 4,387,748 and 4,750,533.

Such automated machinery comprises fill valves by which pressurized gas and beverage are delivered into each can through the open top thereof. Such fill valves comprise standard distal beverage effluent nozzle structure comprising an array of downwardly and outwardly directed beverage discharge passages. This standard effluent nozzle structure is diametrally sized to fit through the opening in the top of a can of predetermined size on a close tolerance basis so that the circular discharge streams of beverage not only angularly strike against the most elevated part of the inside surface of the side wall of the can but also the flow distance between the end of each nozzle passageway and the side wall of the can is minimized whereby beverage foaming is kept within tolerable limits.

Particularly in respect to cans made of aluminum, the beverage industry has continually sought ways to reduce the amount of aluminum used to fabricate each can. Side walls have been materially reduced in thickness. Also, from time to time the beverage industry has reduced the size of the lid placed upon an aluminum can to further reduce the amount of aluminum used. Reduction in lid size correspondingly reduces the pre-lid top opening in the can.

The latest change being implemented by the beverage industry is a reduction in aluminum lid size to a size #204, for the first time. Further lid size reductions can be anticipated. With such reductions in aluminum lid sizes and corresponding reduction in the size of openings at the top of aluminum cans comes obsolescence of certain parts of the beverage-filling machinery. Specifically, a size #204 can will not accept the distal discharge nozzle structure of existing fill valves due to dimension interference. Thus, the progressive movement by the beverage industry to smaller and smaller lids and, therefore, smaller and smaller openings at the top of aluminum cans leaves existing fill valves nonaccommodating. The normal solution in the past to this problem has been to replace the old dimensionally nonaccommodating fill valves with entirely new fill valves which fit, on a close tolerance basis, through the smaller top opening of the cans. This approach, however, on both a plant and an industry-wide basis, is very costly, especially when considering that each new lid size typically has required total replacement of all existing fill valves.

The present invention constitutes a far less expensive and more long term solution to the problem, unaccompanied by any material disadvantages.

BRIEF SUMMARY AND OBJECTS OF THE INVENTION

In brief summary, the present invention resolves the above-mentioned lid size reduction problems and comprises diametrally reduced adapter nozzles, and related methods, used as replacements only for the nonaccommodating distal discharge nozzle structure of fill valves. The existing nonaccommodating distal nozzle structre is normally stainless steel and is removed, using conventional techniques. The adapter nozzle preferably comprises a single die cast stainless steel article, although other materials could be used.

Each adapter nozzle is connected to the nonremoved portion or remainder of the fill valve in sealed relation and comprises a plurality of angularly disposed beverage flow passageways which selectively receive beverage issuing from the remainder of the existing fill valve and discharges the beverage angularly against the top region of the interior surface of the side wall of the can so that foaming, if any, is within tolerable limits. Three relatively wide discharge streams of limited depth are presently preferred. Each adapter nozzle also comprises passageways by which pressurized gas is selectively delivered to and evacuated from the interior of the can.

With the foregoing in mind, it is a primary object to solve or substantially solve the aforesaid lid size reduction problems in a reliable and cost-effective way.

Another paramount object is the provision of a diametrally reduced adapter nozzle for distal modification of a beverage fill valve, and related methods.

A further important object is provision of a novel adapter nozzle useable with cans having a smaller top opening as a replacement for previously existing, removed standard distal discharge fill valve nozzle structure which will not accommodate said cans, and related methods.

Another significant object is the provision of a novel, adapter nozzle, and related methods, by which existing fill valves can be modified for use with beverage cans having smaller top openings.

An object of consequence is the provision of a novel adapter nozzle, and related methods, comprising a single article by which an existing fill valve is modified to accommodate filling of beverage cans having a smaller diametral top opening that can be accommodated by the fill valve without modification.

These and other objects and features of the present invention will be apparent from the detailed description taken with reference to the accompanying drawings.

DETAILED DESCRIPTION OF THE ILLUSTRATED EMBODIMENT

As used in this specification, the term "distal" is intended to designate something more distantly located away from the bulk supply of beverage used to fill cans while the term "proximal" is used to designate something disposed more closely toward the bulk supply of beverage. The present invention is concerned broadly with machinery by which a predetermined quantity of beverage is placed, on an automated basis, sequentially into open top cans after which each can is capped or receives a lid. More particularly, the present invention is concerned with solving the aforementioned lid size reduction problem whereby, with progressive reduction in lid sizes, particularly with aluminum cans, a dimensional interference results between the top lip or edge of the open can and the effluent structure from which the beverage is intended to be discharged as a downward and outward array of streams which are circular in cross section.

Figure 1:
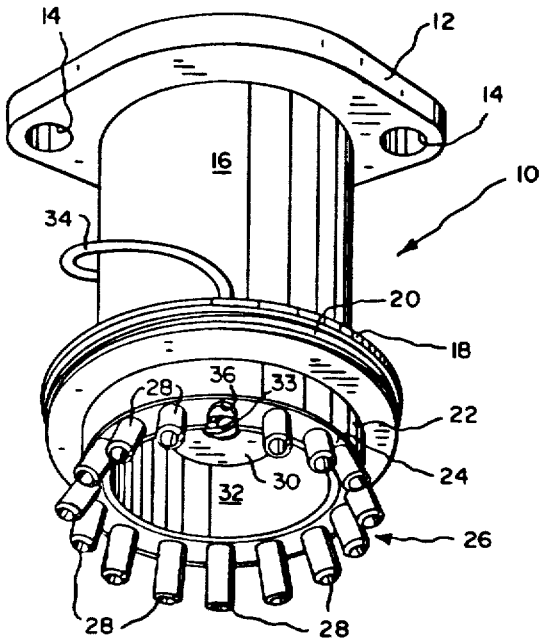
FIG. 1 (PRIOR ART)
FIG. 1 is a perspective representation, as viewed from a relatively low position, of the lower end of a commercial beverage fill valve (with a can-engaging seal removed for purposes of clarity) used with existing automated canning machinery, by which cans of a known size are filled to a predetermined level with a beverage.

Reference is now specifically made to the drawings wherein like numerals are used to designate like parts throughout. With particular reference to FIG. 1, the lower portion of a fill valve, generally designated 10, is shown. Fill valve 10 is intended to be illustrative only, as there are other fill valves presently in commercial use which are constructed somewhat differently, but serve the same purpose in much the same way as fill valve 10 shown in FIG. 1 . Traditionally, such fill valves are formed from stainless steel. In each such commercial fill valve, distal discharge nozzle structure is used by which a plurality of downwardly and outwardly directed beverage effluent flow paths are defined, each of which is substantially circular in cross section. As few as nine and as many as fifteen discharge ports are commercially used. Accordingly, the fill valve 10, illustrated in FIG. 1, is, as such, illustrative of the problem posed by the prior art.

Conventional fill valve 10 specifically comprises a top flange 12, which comprises apertures 14 by which the fill valve 10 is mounted to beverage machinery generally mentioned above in a conventional fashion and for well-known purposes. Fill valve 10 comprises a hollow cylindrical wall 16 through which beverage, such as a carbonated drink or beer, selectively flows. The hollow cylindrical housing 16 merges into an integral radially extending flange 18. Flange 18 comprises internal beverage passageways and exposed threads 20, by which the fill valve 10 is positioned as a part of the aforementioned beverage machinery. Flange 18 integrally merges with a downwardly directed, integral annular boss 22 through which the internal beverage flow passageways continue.

The lower surface 24 of the boss 22 is illustrated as being angularly tapped at fifteen separate sites, as illustrated, to accommodate interference fit insertion of an array of beverage discharge nozzle tubes 26. Each nozzle tube 26 is in communication with one of the internal beverage passageways disposed in flange 18 and boss 22. Each tube 28 of the array is, thus, diagonally disposed in a downward and outward direction and internally comprises a single, angularly oriented, linearly extending central bore. The tubes 28 collectively define a maximum diametral size in the form of array 26 which, on a close tolerance basis, is adapted to fit through the top opening at the upper lip or edge of a beverage can of a predetermined size. The sizing and orientation of the array 26 of nozzle tubes 28 accommodates not only insertion through the open top of a predetermined diametral size of a can but also selective discharge of beverage into the can by directing the beverage as a plurality of circular streams against the interior surface of the side of the can near the top thereof. This maintains foaming of the beverage within tolerable limits.

The fill valve 10 also comprises a central transversely-directed wall 30 apertured at 33 for introduction into the can of pressurized gas prior to delivery of beverage and progressive evacuation of pressurized gas from the can during filling, centrally disposed above the boss 22, the interior surface 32 of which is downwardly and outwardly tapered in a conical fashion substantially parallel to the collective orientation of the array 26 of nozzle tubes 28. A conventional liquid valve operates within the hollow formed by surface 32 to selectively shut off gas flow to equalize pressure and insure proper head space and liquid volume in a can filled by valve 10.

Fill valve 10 also comprises a separate, exteriorly disposed helical tube 34, the hollow of which functions to snift gas from the top of the can at the conclusion of beverage tilting before removing the can from the filling equipment. The hollow of tube 34 communicates selectively with a gas passageway disposed through flange 18 and boss 22. This gas passageway has a port located adjacent the slot 36 whereby, in accordance with conventional operation of the aforementioned beverage machinery, pressurized gas at the top of the can is evacuated therefrom or snifted just before the can removed from the filling machinery.

Because of the close tolerance relationship between the predetermined opening at the top of a specific can to be filled with beverage and the diametral size of the nozzle array 26, reduction in the size of the opening at the top of a beverage can creates a dimensional interference problem of substantial proportions. This problem is illustrated in FIG. 2.

Figure 2:
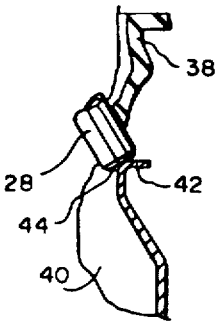
FIG. 2 is an enlarged fragmentary perspective, with some parts shown in cross section for clarity, illustrating the problem addressed, i.e., the inability of the nozzle of the fill valve of FIG. 1 to enter through a beverage-receiving can having a smaller top opening.

FIG. 2 shows one nozzle tube 28, of the previously described array 26, juxtaposed the top edge of a can 40 having a reduced diametral top opening. It also shows a seal 38 carried by the fill valve 10 in contiguous superposition over the exterior of the boss 22, the intent of which is to seal against the top edge of a can. However, with the can 40 of reduced top opening, this is not possible. More specifically, the seal 38 is adapted to engage the upper lip or edge 42 of the can 40 for which the array 26 is sized. However, when can 40 is used having a smaller top opening, the diametral size of the lip or edge 42 of the can 40 as well as the top opening at 44 are such that the distal edge of each nozzle pipe 28 lowers directly on to the lip 42. Can 40 is representative of a No. 204 can. As a consequence, the array 26 of nozzle tubes 28 is incapable of passing into the interior of the can 40, and, if beverage were discharged with the array 26 in the condition illustrated in FIG. 2, the discharged beverage would not be delivered per se to the can, but would spray upon and contaminate the area around the filling site and would provoke an unacceptable level of foaming. In other words, by going to a reduced diametral #204 size for the lip or edge 42 and opening 44, the pre-existing fill valve 10 becomes incompatible and nonaccommodating.

As mentioned earlier, the aforementioned dimensional interference problem has, in the past, been resolved by simply discarding the entire existing supply of fill valves associated with an automated canning facility and fabricating a new supply of fill valves having close tolerance dimensions which will accommodate passage through the diametrally reduced opening 44 of the can 40. The expense of doing this is very substantial and may well be cost prohibitive for at least some canned-beverage producers.

Figure 3:
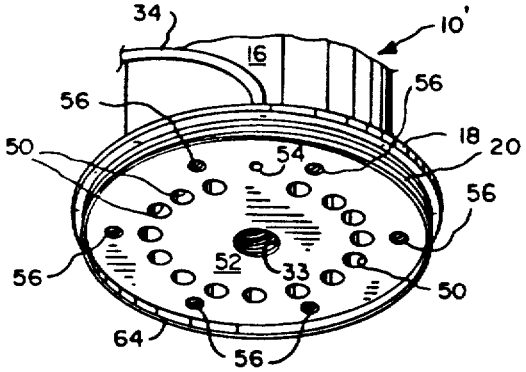
FIG. 3 is an enlarged fragmentary perspective viewing from a relatively low position a portion of the fill valve of FIG. 1, wherein the existing standard distal discharge nozzle structure has been removed, preparatory to receiving an adapter nozzle in accordance with the present invention.

As explained hereinafter, the present invention offers an efficient, long-term, reliable and cost-effective answer to the reduced lid size problem mentioned above. To implement the present invention, the boss 22 and tube nozzles 28 of valve 10 are removed from the remainder of the fill valve 10, that remainder being designated by the numeral 10' in FIGS. 3, 4 and 5. This is preferably done by utilization of standard machining techniques, which need not be described here.

Since the hollow interior of each nozzle tube 28 communicates with a liquid passageway which initially extends through the flange 18 and the boss 22, removal of boss 22 and nozzle tubes 28, as by machining, creates a flat, radially directed surface 52 and leaves an exposed array of beverage passageway ports 50, each located along a common radius from the center of the flange 18. Likewise, a pressurized gas passageway port 54, in which the hollow of the tube 34 is in fluid communication, is similarly exposed at a specific location at the new surface 52 of flange 18. The gas influent and effluent port 33 also remains.

The flange 18 is further tapped at a plurality of predetermined sites 56 for receipt of fasteners. In the illustrated embodiment, the tapped sites 56 are threaded.

An adapter nozzle, embodying the principles of the present invention, is mounted upon the modified fill valve 10' in contiguous relation with surface 52 to resolve the aforementioned problem. One presently preferred adapter nozzle is illustrated in FIGS. 4–8. Preferably, the adapter nozzle of FIGS. 4–8, generally designated 60, is formed as a single die cast piece of stainless steel, although other materials, such as synthetic resinous material may, in the alternative, be used where desirable and appropriate. Adapter nozzle 60 is specifically configurated to be mounted upon either a Crown fill valve or a Cemco fill valve, after the modification thereto which is described above.

Figure 4:
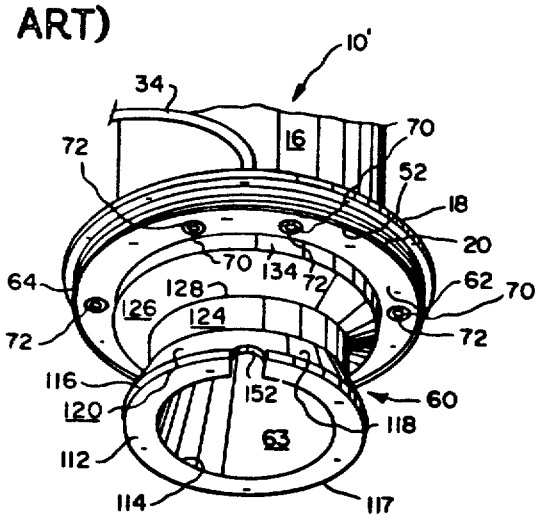
FIG. 4 is an enlarged fragmentary perspective viewed from a relatively low position illustrating a presently preferred adapter nozzle, embodying the principles of the present invention, installed upon the modified fill valve of FIG. 3.
Figure 8:
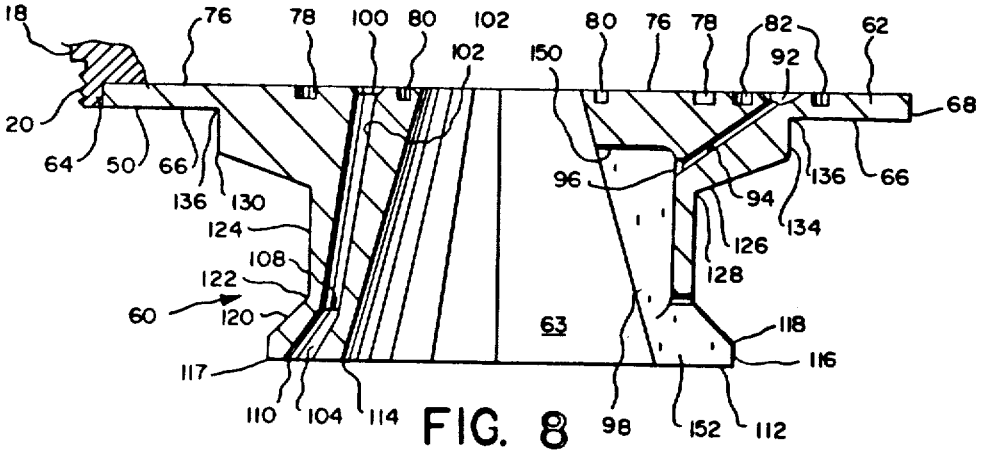
FIG. 8 is an enlarged cross-sectional view taken along lines 8—8 FIG. 6.

Adapter nozzle 60 is generally annular in its configuration, having a tapered hollow frusto-conical interior, at 63 through which influent and effluent pressurized gas from port 33 passes, and a stepped exterior. The body of material comprising adapter nozzle 60 comprises a top flange 62. Flange 62 has a uniform outside diameter illustrated as being just smaller than the diameter at threads 20 of the flange 18. Preferably, as shown in FIG. 8, surface 52 is recessed so that an annular lip 64 is formed, the bottom surface of which is essentially flush with the bottom surface 66 of the flange 62. The flange 62 is illustrated as being of uniform thickness and terminates in an annular edge 68. Flange 62 is apertured at six sites. The apertures 70 are selected so as to be aligned with threaded bores 56. Consequently, as shown in FIG. 4, each aperture 70 is aligned with a threaded bore 56 for receipt of an Allen head screw 72. The threaded end of each Allen head screw 72 fits loosely through the associated aperture 70 and threadedly engages the threads of the associated bore 56. Preferably, each aperture 70 is counterbored at the lower surface 66 of the flange 62 so that the Allen head fasteners 72 are essentially flush with surface 66 upon installation. As a consequence, the adapter nozzle 60 is securely fastened to the modified fill valve 10', as shown in FIG. 4.

Figure 6:
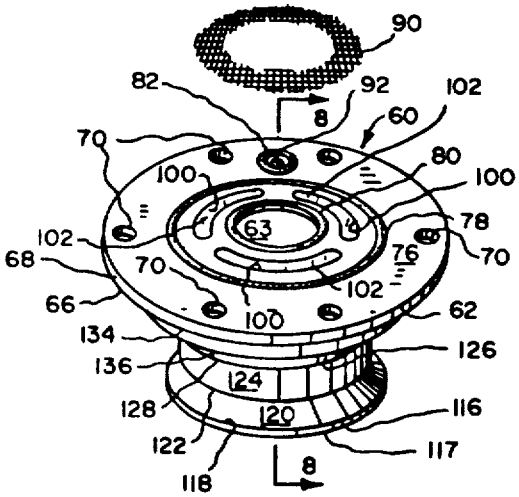
FIG. 6 is an enlarged fragmentary exploded perspective, viewed from an elevated position of the adapter nozzle of FIG. 4 shown removed from the modified fill valve of FIG. 3 and having a beverage screen resting on the top surface.
Figure 7:
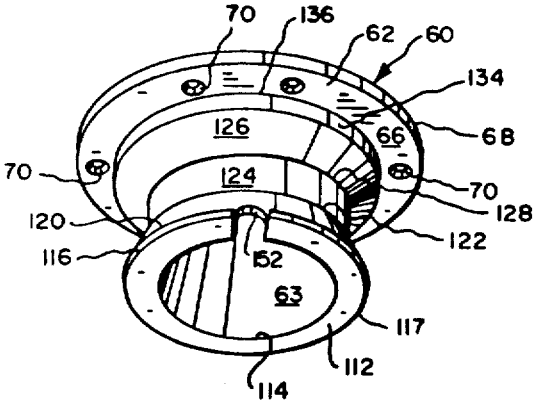
FIG. 7 is an enlarged fragmentary perspective of the adapter nozzle of FIG. 4, viewed from a relatively low position, shown removed from the modified fill valve of FIG. 3.

As best seen in FIG. 8, the adapter nozzle 60 comprises a top surface 76, which is planar or flat and extends across the entirety of the adapter nozzle 60 including but not limited to the flange 62. The top surface 76 is interrupted by three annular grooves 78, 80 and 82. An appropriately-sized O-ring is positioned within each of the grooves 78, 80 and 82, as best illustrated in FIG. 6. The mentioned three O-rings constitute the manner in which the adapter nozzle 60 is sealed against the modified fill valve 10' at surface 52 against beverage and pressurized gas leakage. If desired, depending upon the composition and nature of the beverage being dispensed through the adapter nozzle 60, an arcuate screen 90 (FIG. 6) may be superimposed upon the top surface 76 between the grooves 78 and 80 for filtration of beverage and, in the case of beer, for accommodating surface tension shut off a beverage flow.

The top surface 76 of the adapter nozzle 60 is also interrupted by a snifter port 92 of a snifter gas passageway 94. See FIG. 8. The O-ring located in groove 82 seals against loss of gas pressure between the adapter nozzle 60 and the surface 52, while the O-rings in grooves 78 and 80 seal against beverage loss. The effluent gas passageway 94 also comprises a second port 96 (FIG. 8), which opens to the conical interior 63 at a recessed portion 98 of the adapter nozzle 60. The location of port 92 is adapted to be aligned with port 54 at surface 52. As beverage is introduced into the can through the adapter nozzle 60, pressurized gas earlier placed in the can via port 33 and hollow 63 is progressively evacuated from the can via hollow 63 and port 33.

The conically-shaped hollow interior 63 of the adapter nozzle 60 functions to minimize the amount of material used in fabricating the adapter nozzle 60, to deliver influent and effluent pressurized gas to and from the can, accommodates displacement of the conventional ball cage or gas shut-off valve and works in cooperation with the can 40 to occupy only that space within can 40 which results in the desired head space in the can whereby the correct predetermined beverage volume is precisely dispensed into the can. The upper end of the frustro conically-shaped hollow 63 centrally interrupts the surface 76 of the adapter nozzle 60.

The surface 76 of the adapter nozzle 60 is further interrupted by three arcuately-shaped beverage influent ports 100, which are disposed along a common radius from the center line of the adapter nozzle 60 and which may be described as slots. Each arcuate influent port 100 is relatively wide and of a thin depth. In the illustrated embodiment, five successive beverage-dispensing ports 50 (FIG. 3) selectively provide influent beverage to each influent port 100. Thus, each influent port 100 is aligned with five effluent ports 50 and, therefore, five beverage streams of circular cross section are converted into one wide, thin stream of beverage. Such beverage is displaced, under force of the beverage-canning machinery mentioned above, downwardly from the fifteen ports 50 through the ports 100 and thence along the three outwardly and downwardly tapered passageways, each passageway comprising two segments having different successive angles of orientation, i.e., a first arcuately disposed angular passageway segment 102 from port 100 to site 108 and a second arcuately disposed angular beverage passageway segment 104. Each passageway segment 104 has a sharper radial angle than the associated passageway segment 102. Each associated sequential passageway segments 102 and 104 merge at an angular transitional location 108. As a consequence, the overall maximum diametral size of the adapter nozzle 60 below the flange 62 is of reduced size so as to accommodate displacement through the top opening of a No. 204 can. Yet issuance of beverage emanating from each of the three effluent ports 110 of passageway segments are directed angularly against the interior surface of the sidewall of the can 40 at an elevated location so that foaming is within tolerable limits.

The adapter nozzle 60, as stated, is illustrated as being of one piece construction and comprises a bottom transverse, radially-directed annular planar surface 112 through which each of the three ports 110 emanates. Surface 112 integrally merges with interior frustroconical surface 63 at an annular corner 114. Surface 112 also integrally merges at annular outside corner 117 with an exterior annular surface 116, which has a uniform diameter. Surface 116 integrally merges at outside corner 118 with diagonal surface 120. Surfaces 116 and 120 and corner 118 as well as corner 117 are exposed at the exterior of the adapter nozzle 60. Diagonal surface 120 merges at inside corner 122 with annular surface 124. Surface 124 is of uniform diameter and integrally merges with diagonal surface 126 at inside corner 128.

Diagonal surface 126 merges with annular surface 134 at outside corner 130. Annular surface 134, is of uniform diameter throughout. Surface 134 integrally merges with the lower surface 66 of flange 62 at inside corner 136.

Pressurized gas communication recess 98 comprises an arcuate top surface 150. The recess 98 communicates to the exterior of the adapter nozzle 60 and thence to the interior of can 40 across a notch 152, whereby gas at the top of the can 40, during progressive filling, is evacuated to the exterior of the can 40 through hollow 63 and port 33. Snifting of gas from the top of the can 40 occurs across notch 152, and through recess 98, port 96, passageway 94, port 92, port 54 and conduit 34.

Figure 5:
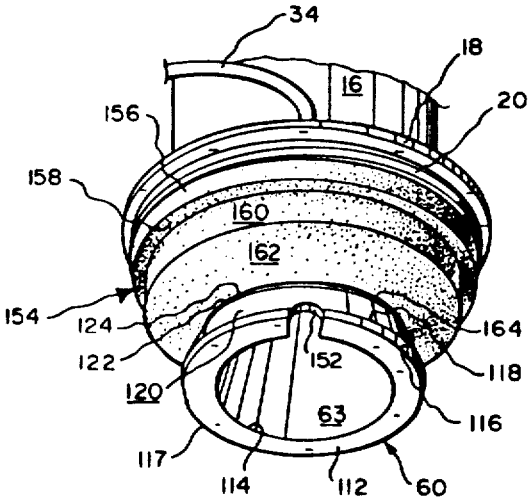
FIG. 5 is a fragmentary enlarged perspective, viewed from a relatively low position, similar to FIG. 4 further illustrating a can top seal superimposed upon the adapter nozzle.

With particular reference to FIG. 5, it is to be appreciated that for use in the installation of adapter nozzle 60, an essentially standard elastomeric seal 154 is stretched and released and thereby superimposed upon the exterior of the adapter nozzle 60 so as to be interiorly contiguous with the surfaces 66, 134, 132, 126 and 124. Elastomeric seal 154 is substantially conventional and comprises an exposed annular surface 156 forming a part of a flange the maximum diameter of which is substantially equal to the diameter of edge 68. The flange comprising annular surface 156 also comprises lower, radially-directed surface 158. Below the seal flange 156/158 is disposed a reduced diameter annular surface 160, the diameter of which is somewhat greater than the top opening of can 40 at site 44 (FIG. 2). Surface 160 merges with a tapered surface 162. Tapered or diagonal surface 162 serves to physically compressively engage the edge 42 of the can 40 to create a liquid and gas seal to prevent inadvertent escape of either pressurized gas or beverage from the can 40 during filling and snifting. The diagonal surface 162 merges with the hollow interior of the seal 154 at lower annular corner or edge 164. The hollow interior of the seal is configurated so as to contiguously match the external configuration of the adapter nozzle 60, as described above. The hollow interior of the beverage can seal 154 seals against the above-mentioned exterior surfaces of the adapter nozzle 60 so that gas or liquid leakage between the adapter nozzle 60 and the seal 154 cannot occur.

Figure 9:
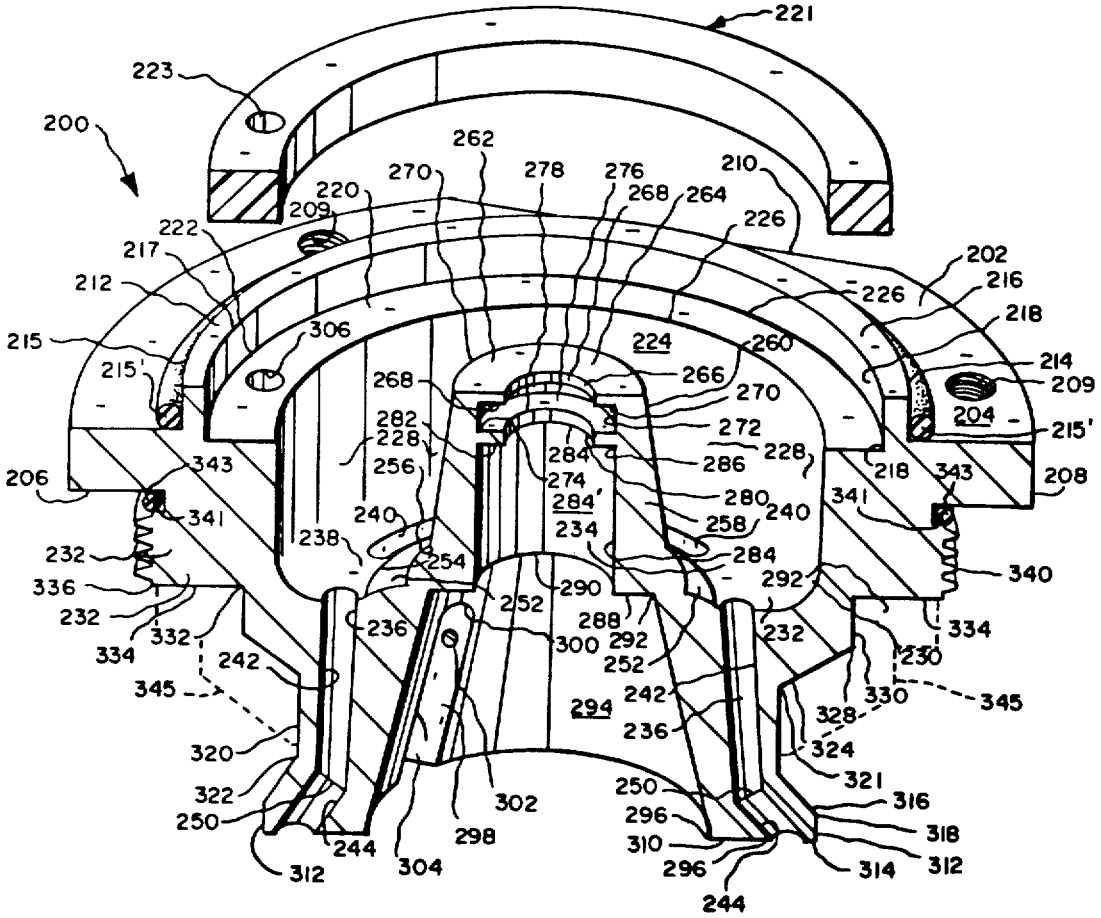
FIG. 9 is a fragmentary perspective of a second presently preferred adapter nozzle according to the present invention with parts shown in cross section for clarity.

Reference is now made to FIG. 9, which illustrates in enlarged fragmentary perspective a second presently preferred adapter nozzle with structural differences when compared with adapter nozzle 60 predicated primarily upon the basis that adapter nozzle 200 is intended to be used with the well-known Meyers fill valve after being modified by detaching the distal nozzle portion thereof by bolt removal.

The adapter nozzle 200 addresses the same problem mentioned above, when applied to a Meyers fill valve and is preferably formed of stainless steel through use of conventional die casting techniques, although other suitable beverage-inert materials could be used. The adapter nozzle 200 comprises a stepped hollow interior and a stepped interior, fashioned to minimize the quantity of material used in fabricating the adapter nozzle 200, to accommodate flow of influent and effluent pressurized gas through the central hollow interior of the adapter nozzle 200, to accommodate displacement of a conventional ball cage or gas shut-off valve within the hollow interior and works in cooperation with the can 40 to occupy only that space within can 40 which results in the desired head space in the can whereby the correct predetermined beverage volume is precisely dispensed into the can. Specifically, adapter nozzle 200 comprises a radially-directed top flange 202, illustrated as having a uniform thickness and comprising top surface 204, bottom surface 206 and edge 208. Four apertures 209 are disposed in the flange 202, located and size to be aligned with threaded bores existing in the Meyers fill valve for receipt of screw fastener whereby the adapter nozzle 200 is secured to the modified Meyers fill valve. The flange 202 is circular in its configuration, with the exception of two linear edge segments 210, which are oppositely disposed at 180-degree positions. Only one linear edge 210 is illustrated. Linear edges accommodate a non-interference union with the modified Meyers fill valve.

Integral with and extending in an upward direction from flange 202 along a common radius is an annular wall 212. Wall 212 is illustrated as being essentially rectangular in cross section and has an outside diameter slightly greater than the unstressed diameter of an O-ring 215' which is stretched over and compressively contracts against the wall 212 due to the memory of O-ring 215', as illustrated in FIG. 9. The O-ring 215' serves to seal the adapter nozzle 200 to the modified Meyers fill valve against inadvertent loss of beverage during the filling operation.

Annular wall 212 is illustrated as comprising an outside wall surface 214, a top wall surface 216 which merges with wall surface 214 at annular corner 215, and interior wall surface 218 which integrally merges with top wall surface 216 at annular corner 217. The wall 212 is illustrated as having a vertical dimension greater than the diameter of the O-ring 215'. Interior wall surface 218 merges with radially-directed, planar surface 220 at annular inside corner 222. Flat surface 220 is illustrated as being disposed within the same plane as surface 204.

An annular gasket 221, preferably of rigid synthetic resinous shape-retaining material, fits snugly upon surface 220 and contiguously engages wall surface 218. Gasket 221 is illustrated as being of rectangular cross section and comprises a snifter gas passageway 223.

Surface 220 merges with annular, vertically-directed surface 224 at annular outside corner 226. Vertical surface 224 is disposed at a predetermined diameter from the longitudinal center line of the adapter nozzle 200. Wall surface 224 forms a portion of a common beverage reservoir 228, which selectively receives beverage from the modified Meyers fill valve. Annular, vertically-directed wall surface 224 merges at inside corner 230 with diagonally-disposed, downwardly and inwardly tapered surface 232. The lower edge 234 of surface of 232 intercepts each of three downwardly-directed beverage passageways 236, which are spaced one from the next by a supporting rib 238.

As is the case with adapter nozzle 60, the passageways 236 of adapter nozzle 200 are concentrically disposed around the longitudinal axis of the adapter nozzle 200, each passageway 236 comprising a beverage influent, arcuate slot 240. The conventional beverage seal at the end of the liquid valve seat retainer is disposed reciprocally in the beverage reservoir 228 and is selectively closed upon and lifted from the influent slots 240 to respectively stop and accommodate beverage flow through the passageways 236.

Each of the three passageways 236 comprise two successive passageway segments, a first passageway segment 242 which is downwardly and outwardly arcuately configurated at a first predetermined angle in respect to the longitudinal axis of the adapter nozzle 200, and a second passageway segment 244, disposed at a sharper angle in respect to the axis of the adapter nozzle 200. The two passageway segments 242 and 244 of each passageway 236 merge at an elbow site 250. Opposite the diagonal wall 232 and disposed interior thereof is a second beverage reservoir diagonal surface 252. Diagonal surface 252 extends downwardly and outwardly and intersects each of the three beverage flow slots 236 at edge 254.

Wall surface 252 intersects, at inside annular corner 256, a vertically-directed wall 258. Wall 258 comprises an outside vertically-directed, slightly tapered surface 260 which merges with tapered surface 252 along inside corner 256. Surface 260 merges with a radially-directed top central wall 262, which comprises top surface 264, annular edge surface 266, defining a central aperture therethrough and lower surface 268. Surface 268 merges with vertically-directed annular surface 272 at inside corner 270. Surface 272 merges at corner 274 with transverse planar surface 276, which in turn at outside corner 278 merges with vertically-directed annular edge surface 280. The aligned apertures formed by edge surface 266 and 280 snugly receive in reciprocal relation a conventional Meyers' valve stem to which the liquid valve seat retainer is connected at the distal end thereof.

Edge 280 merges with undersurface 282 at outside corner 284. Surface 282 merges with vertically-directed cylindrical surface 284' at inside corner 286.

Annular or cylindrical surface 284 merges with radially-directed interior surface 288 at outside corner 290. Radial surface 288 merges at annular inside corner 292 with interior surface 294. Surface 294 extends downwardly and outwardly in an arcuate configuration and terminate in a lower annular edge 296. Fashioned into the wall forming the inside surface 294 is a recess 298 which comprises an arched top 300, a gas snifter port 302 and a snifter passageway 304 by which snifted gas flows between the port 302 and the top interior portion of the can 40, after filling. A snifter passageway extends between the interior port 302 and a second port 306, located along surface 220 to accommodate flow of snifter gas between ports 306 and 302. The gasket 221 fits upon surface 220 so that snifter aperture 223 thereof is aligned with the snifter port 306. Gasket 221 prevents loss of pressurized gas. A conventional metal snifter gas tube of the Meyers fill valve fits into the top of the aperture 223. Thus, snifter gas flows selectively from passageway 304 through recess 298, port 302, port 306, aperture 223 into the Meyers snifter tube and the can 40. Notch 304, recess 298 and hollow 294 as well as the apertures form by edges 280 and 266 accommodate evacuation from the top of the can 40 during filling.

Downwardly and outwardly tapered surface 294 merges, at bottom corner or edge 296, with a radially-directed annular flat base surface 310, at which each beverage effluent slot 244 opens. The directions of passageway segments 244 and locations of the slots 244 insure that beverage flow from the adapter nozzle 200 strikes the inside surface of the can 40 near the top thereof so that foaming of the beverage is within tolerable limits.

Base surface 310 merges with vertically-directed, annular surface 312 at annular outside corner 314. Surface 312, in turn, merges with diagonal surface 316 at outside corner 318. Diagonal surface 316 merges with vertically-directed, annular surface 320 at inside corner 322. Annular surface 320 merges with diagonal surface 324 at inside corner 321. Diagonal surface 324, in turn, merges, at outside corner 328, with vertically-directed, outside annular surface 330. Surface 330 merges at inside corner 332 with radially-directed, annular surface 334. Annular surface 334, at outside corner 336, integrally merges with vertically-directed threaded surface 340. Threaded surface 340 accommodates threaded connection to the conventional can guide sleeve of the Meyers fill valve. Surface 340 is interrupted by a groove 341 in which an O-ring seal 343 is located. O-ring 343 seals against the Meyers conventional guide sleeve. The top surface of the groove 341 is an extension of the bottom surface 206 of the flange 202.

It is to be appreciated that a can seal 345 similar to seal 154 (FIG. 5) is mounted in sealing relation upon some of the exterior surfaces of the adapter nozzle 200, i.e., surfaces 320, 324, 330 and 334, whereby the top opening 44 at top flange 42 of can 40 (FIG.2), is engaged by the can seal located on the exterior of the adapter nozzle 200 so that the edge of the can is sealed against inadvertent loss of pressurized gas and/or beverage during the filling process. Can seal 345 is shown in dotted lines in FIG. 9.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A method of modifying an existing nozzle head having a predetermined maximum diametral size in excess of a size accommodating efficaciously filling of a commercial can of reduced top opening size to one which accommodates filling of any of a plurality of commercial cans including said reduced sized cans having variously sized top openings, comprising the steps of :

removing from the existing nozzle head only distal beverage discharge structure having said predetermined maximum diametral size which comprise means defining a radial array of outwardly directed diagonally disposed beverage dispensing flow pathways and effluent discharge ports while retaining for use a proximal portion of the nozzle head comprising an upstream portion of said flow pathways;

attaching and sealing a different distal adapter having passageways therein and having a maximum diametral size less than the predetermined maximum diametral size to the retained proximal portion of the existing nozzle head to provide a hybrid nozzle head in superposition over the upstream portion so that the flow pathways are selectively aligned with the passageways.

2. A method of converting a fill valve having a predetermined maximum diametral size in excess of a size accommodating efficaciously filling of a commercial can of reduced top opening size to one which accommodates filling of any of a plurality of commercial cans including said reduced sized cans having variously sized top openings, comprising the steps of:

removing existing distal fill valve structure having said predetermined maximum diametral size thereby removing means which define a radial array of outwardly directed diagonally disposed beverage dispensing flow pathways and effluent discharge ports but preserving a proximal portion thereof which comprises an upstream portion of said array of flow pathways;

attaching and sealing a distal adapter having a maximum diametral size less than the predetermined maximum diametral size in superposition over the upstream portion;

the removing step comprising machining the distal fill valve structure from the proximal portion.

3. The method according to claim 1 wherein the removing step comprises detaching the existing nozzle head distal beverage discharge structure from the existing proximal portion.

4. The method according to claim 1 wherein the sealing step comprises interposing at least one seal between the proximal portion of the existing nozzle head and the different distal adapter.

5. The method according to claim 1 wherein an interface exists between the proximal portion of the existing nozzle and the attached different distal adapter and wherein the sealing step comprises placing at least two O-ring seals at the interface between the proximal portion of the existing nozzle head and the different distal adapter out of alignment with the flow pathways and the passageways.

6. The method according to claim 1 wherein the attaching step comprises connecting the proximal portion of the existing nozzle head and the different distal adapter using fasteners.

7. A method of using existing beverage canning machinery to fill cans smaller in top opening diametral size than can be directly accommodated by said machinery, comprising the steps of:

removing an existing non-accommodating nozzle head from the machinery;

separating a non-accommodating distal portion of the existing non-accommodating nozzle head from a proximal portion of the existing nozzle head;

attaching the proximal portion of the existing head to the machinery after securing to the proximal portion a diametrally smaller flow accommodating distal nozzle adapter;

thereafter placing the distal nozzle adapter through a top opening of one of said cans;

delivering beverage by said machinery through the proximal portion to the distal nozzle adapter;

displacing said beverage outwardly and downwardly along a plurality of flow paths through the distal nozzle adapter and issuing beverage from the distal nozzle adapter angularly against an interior surface of a side of a can.

8. The method according to claim 7 wherein the issuing of beverage comprises discharge of beverage from the adapter nozzle as a plurality of relatively broad and thin streams.

9. The method according to claim 8 wherein the issuing comprises delivering three effluent streams of beverage.

10. The method according to claim 7 further comprising the step of delivering pressurized gas to the interior of the can through the adapter via a gas flow passageway prior to flow of beverage through the distal nozzle adapter into the can, followed by progressive evacuation of said pressurized gas from the interior of the can as beverage is progressively delivered to the interior of the can.

11. The method according to claim 7 further comprising the step of sealing on an edge of the top opening of the can by impressing a separate elastomeric seal, carried in superimposed relation upon the distal nozzle adapter, upon the edge prior to beverage flow.

12. A replacement distal nozzle adapter used for filling a beverage can having a top opening size smaller than that which is capable of being filled using a standard nozzle head, the replacement distal nozzle adapter comprising:

means by which the distal nozzle adapter is distally attached to a proximal portion of the standard nozzle head after a distal portion of the standard nozzle head has been removed;

means by which the nozzle adapter is placed in sealing relation with the proximal portion;

radially disposed beverage flow path defining wall means having a maximum diametral size accommodating displacement thereof through the top opening into the can, the beverage flow path defining wall means defining a plurality of enlarged broad assymetrical passageways extending downwardly and outwardly, each passageway comprising beverage influent port means and beverage effluent port means by which beverage issuing therefrom is steered to angularly strike an interior side of the can as enlarged broad assymetrical streams;

gas flow accommodating means in the nozzle adapter by which pressurized gas is introduced through the top opening into the smaller size can prior to beverage flow and progressively removed during progressive beverage flow.

13. The distal nozzle adapter according to claim 12 wherein the attached means comprise a flange.

14. The distal nozzle adapter according to claim 12 wherein the attached distal nozzle adapter comprises a one-piece article.

15. The distal nozzle adapter according to claim 12 further comprising means for receiving a seal in superimposed relation upon the distal nozzle adapter for engagement with the can at the smaller top opening.

16. The distal nozzle adapter according to claim 12 wherein the sealing means comprise at least one O-ring.

17. The distal nozzle adapter according to claim 12 wherein the sealing means comprise at least two O-rings.

18. The distal nozzle adapter according to claim 12 wherein each passageway comprises, in cross section, a segment of an arc.

19. The distal nozzle adapter according to claim 18 wherein the passageways comprise three arcuate segments disposed along a common radius which collectively are adapted to receive beverage from the proximal portion.

20. The distal nozzle adapter according to claim 12 wherein the gas flow accommodating means comprise a throughbore in the wall means adapted to communicate with the interior of the can at one end of the throughbore and with a gas passageway in the proximal portion of the nozzle head at another end of the throughbore.

21. The distal nozzle adapter according to claim 12 wherein each one of the plurality of beverage flow passageways in the wall means comprise first and second successive distinct angles of flow.

22. The distal nozzle adapter according to claim 12 wherein the center thereof is hollow.

23. The distal nozzle adapter according to claim 12 comprising screen means interposed over the influent port means of the adapter nozzle.

24. A hybrid reconstructed nozzle head by which a beverage can having a top opening size smaller than that which is capable of being filled using a standard nozzle head of a fill valve, the hybrid reconstructed nozzle head comprising:

a proximal portion of said standard nozzle head, the proximal head portion comprising internal beverage first flow path defining means;

a distal portion comprising a non-standard nozzle head adapter displaceable into said top opening comprising second internal flow path defining means;

means for fastening the distal portion to the proximal portion at interface means so that the first and second flow path defining means are aligned;

transition means adjacent the interface means, the transition means comprising means transferring the beverage flow from the first flow path defining means of the proximal portion into the second flow path defining means which provide a flow of a different character comprising in cross section a plurality of non-circular, broad and thin downwardly and outwardly directed streams.

25. The hybrid reconstructed nozzle head according to claim 24 wherein the second flow path defining means define in cross section a plurality of arcuate broad and thin downwardly and outwardly directed flow path cavities.

26. The hybird reconstructed nozzle head according to claim 24 wherein the second flow path defining means define in cross section a plurality of lobe shaped flow path cavities.

27. The hybird reconstructed nozzle head according to claim 24 wherein the second flow path defining means define in cross section a radial array of broad and thin arcuately-shaped flow path cavities.

28. The hybird reconstructed nozzle head according to claim 27 wherein the flow path cavities comprise three.

29. The hybird reconstructed nozzle head according to claim 24 wherein the second flow path defining means define flow path cavities which change the downward and outward flow direction of each stream at least once through a predetermined angle.

30. The hybird reconstructed nozzle head according to claim 29 wherein said angle is acute.

31. A nozzle head for filling a beverage can having a top opening size smaller than that which is capable of being filled using a standard nozzle head of a fill valve, the nozzle head comprising:

a standard proximal portion;

a distal portion comprising a non-standard nozzle head adapter attached to the standard proximal portion and sized and shaped to accommodate displacement into said top opening, the distal portion comprising internal flow path defining means;

the internal flow path defining means comprising means transforming beverage flow received from the proximal portion into a flow of a different character comprising in cross section a plurality of non-circular, broad and thin downwardly and outwardly directed streams.

32. A method of modifying nozzle head construction in existing beverage canning machinery to fill cans each having a top opening smaller in diametral size than can be directly accommodated by said machinery without modification, comprising the steps of:

eliminating only a distal portion of at least one standard nozzle head of the machinery;

retaining a proximal portion of said standard nozzle head;

combining a non-standard distal nozzle head adapter with the retained proximal portion so that the resulting nozzle head combination is operatively positioned for beverage discharge in the machinery;

placing the non-standard distal nozzle head adapter of the operatively positioned nozzle head combination through the smaller top opening of one can;

delivering beverage from the machinery through the nozzle head combination, the distal nozzle head adapter discharging a plurality of relatively thin broad streams of beverage into the interior of the can.

33. A non-standard replacement nozzle head adapter used as an attachment within a can filling and sealing machine comprising:

means for compatibly attaching the non-standard replacement nozzle head in beverage flow relation to a standard proximal portion of a standard nozzle head from which the distal portion thereof has been removed;

at least one internal downwardly directed gas passageway through which gas is transferred to and from a beverage-receiving can;

at least one internal downwardly and outwardly directed liquid passageway which is broad, flat and non-circular in cross section for receiving liquid from flow paths in the proximal portion and delivering said liquid to the can;

means by which the gas passageway is separated from the liquid flow passageway;

transition means within the passageway for internally transforming the liquid flow received from the proximal portion into a broad, flat, non-circular flow pattern corresponding to the cross section of the liquid passageway.

34. Nozzle head structure for a can filling and sealing machine from which a predetermined flat pattern of effluent liquid flow emanates, said nozzle head structure comprising:

a distal portion defining:

at least one internal downwardly directed gas flow passageway for transferring gas between the filling and sealing machine and the can;

at least one non-circular broad and flat liquid flow passageway for discharging liquid from the distal portion to the can;

means within the nozzle head structure for maintaining the gas passageway separate from the liquid flow passageway;

liquid flow transition means for permitting a change in characteristics of influent liquid flow between the distal portion and the liquid flow passageway to the broad, flat non-circular flow discharged from the liquid flow passageway, said broad, flat non-circular discharge flow being at substantially a volumetric flow rate and in a direction consistent with minimizing foaming during filling;

the distal portion further comprising a narrow nose for entering the can having a narrow top opening and for conducting effluent liquid flow from the liquid flow passagway against the can.

35. Nozzle head structure comprising a distal portion by which a beverage can having a relatively small top opening is filled with beverage, the distal portion of the nozzle head comprising:

a nose portion which is displaceable into said top opening;

means defining an internal flow path disposed within the distal portion, the internal flow path defining means comprising means disposed at said nose portion for dicharging effluent beverage;

the internal flow path defining means comprising means for forming upper and lower successive inter-connected passageways, the upper and lower passageways having substantially the same cross sectional configuration and angularly disposed one in respect to the other.

36. A nozzle head according to claim 35 wherein a first angle of flow in the upper passageway is primarily downwardly directed and a second angle of flow in the lower passagway is flared outwardly to accommodate discharge of effluent beverage directly against a wall of the can.

* * * * *